United States Patent [19]

Collins et al.

[11] 4,412,780

[45] Nov. 1, 1983

[54] RATE INITIAL PRESSURE LIMITER

[75] Inventors: David J. Collins; James E. Van Doren, both of Scotia, N.Y.

[73] Assignee: General Electric Company, Schenectady, N.Y.

[21] Appl. No.: 248,529

[22] Filed: Mar. 27, 1981

[51] Int. Cl.[3] ..... F01D 17/08

[52] U.S. Cl. ..... 415/17; 415/49; 60/667

[58] Field of Search ..... 415/17, 16, 29, 49; 416/16; 60/667, 665

[56] References Cited

U.S. PATENT DOCUMENTS

| | | | |
|---|---|---|---|
| 2,863,283 | 12/1958 | Schmider et al. | 415/16 X |
| 3,238,376 | 3/1966 | Ernst et al. | 415/17 X |
| 3,421,531 | 1/1969 | Watson | 415/29 |
| 3,572,958 | 3/1971 | Kure-Jensen | 415/17 |
| 3,682,564 | 8/1972 | Feeney | 415/16 |
| 3,802,189 | 4/1974 | Jenkins, Jr. | 60/665 |
| 3,971,219 | 7/1976 | Taylor et al. | 415/17 X |
| 4,002,065 | 1/1977 | Lardi et al. | 415/16 X |
| 4,059,960 | 11/1977 | Osborne | 415/16 X |
| 4,178,762 | 12/1979 | Binstock et al. | 60/667 |
| 4,225,284 | 9/1980 | Masek et al. | 415/16 |

FOREIGN PATENT DOCUMENTS

| | | | |
|---|---|---|---|
| 2903658 | 8/1980 | Fed. Rep. of Germany | 60/667 |

*Primary Examiner*—Philip R. Coe
*Assistant Examiner*—Frankie L. Stinson

[57] ABSTRACT

A control system for a steam turbine is disclosed which is operative to protect the turbine from the effects of sudden changes in steam supply pressure, and in particular to protect the turbine from the effects of water induction such as occurs with a sudden drop in steam pressure supplied by a boiler. In a preferred embodiment, a signal is created which represents the time rate of change of steam supply pressure. This derivative signal is compared with a preselected threshold value to produce a pulse signal whose duty cycle is proportional to the amount by which the rate of change of pressure exceeds the preselected threshold value. The pulse signal causes a proportional pulsing of a motor adapted to reduce a turbine load limit and effect a closing of steam admission control valves to counteract the change in steam pressure and reduce the potential for passing wet steam to the turbine. Additionally included are means for on-line testing of the control system; means for annunciating its status; and means to lock the system out of service at the option of operating personnel.

10 Claims, 3 Drawing Figures

RATE INITIAL PRESSURE LIMITER

BACKGROUND OF THE INVENTION

This invention pertains to protection and control systems for large steam turbines and in particular to a control system which is operative to protect the turbine from the effects of sudden changes in steam supply pressure.

There is, in the electrical power generating industry, a continual search for ways to generate electricity more economically and more efficiently. In the current situation of high energy consciousness, with fuel for power plants at an absolute premium, efficiency boosting techniques and methods of operation once thought to be of marginal value in view of other related problems associated with some of these methods are now being turned to to achieve even fractional increases in power output per unit of fuel (i.e., improved heat rates).

One technique that is getting increased attention in this regard is known as "sliding pressure operation." Useful with the large steam turbines commonly employed in the commercial scale generation of power, sliding pressure operation allows the turbine to be operated with the steam admission control valves substantially wide open while load changes (on the generator end of the tubine-generator set) are sustained by causing the boiler to produce more or less steam energy. This mode of operation minimizes the pressure drop across the control valves at reduced loads and therefore provides a significant improvement in heat rate under those conditions. As might be expected, however, this mode of operation requires some tradeoffs in other operating considerations.

For example, to achieve the sliding pressure operation, a proportional initial pressure regulator ordinarily used, must be deactivated. Should a sudden drop in steam pressure then occur, a rather violent reaction is produced in the boiler, causing liquid water to form in the steam. This can be carried into the tubine with potentially devastating effect. This phenomenon, known as water induction, must be carefully guarded against to protect the internal components of the turbine.

It is therefore an objective of the present invention to provide means for protecting a steam turbine from the effects of water induction such as occurs with a sudden drop in steam pressure at the boiler. The invention has particular utility when applied to turbines adapted to sliding boiler pressure operation and for which the normal initial pressure regulation mechanism has been disarmed to achieve that mode of operation.

SUMMARY OF THE INVENTION

In a rate initial pressure limiter according to a preferred embodiment of the invention, pressure sensing means first provides a signal representation of the main steam pressure. This signal is then processed by derivative determining means to obtain a signal representation of the time rate of change of main steam pressure. The derivative signal is compared with a preselected threshold value to produce a pulse signal whose duty cycle is proportional to the deviation between the rate of change of pressure and the preselected threshold value. With the pressure changing at a rate in excess of the value preselected, the pulse signal causes a proportional pulsing of a motor which is configured to reduce a turbine load limit and thereby effect a closing of the steam admission control valves. Causing the control valves to close reduces the flow of potentially wet steam to the turbine and has the effect of counteracting the change in steam pressure. Additionally, means are preferably provided for adjusting the saturation value of the pulse signal, i.e., the rate of change of steam pressure at which the pulse duty cycle equals 100%, or the pulse remains fully on; means for on-line testing of such rate initial pressure limiting system; means for indicating the position of the load limit motor; means for annunciating the status of the system and the steam pressure; and means to lock the system out of service at the option of operating personnel.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
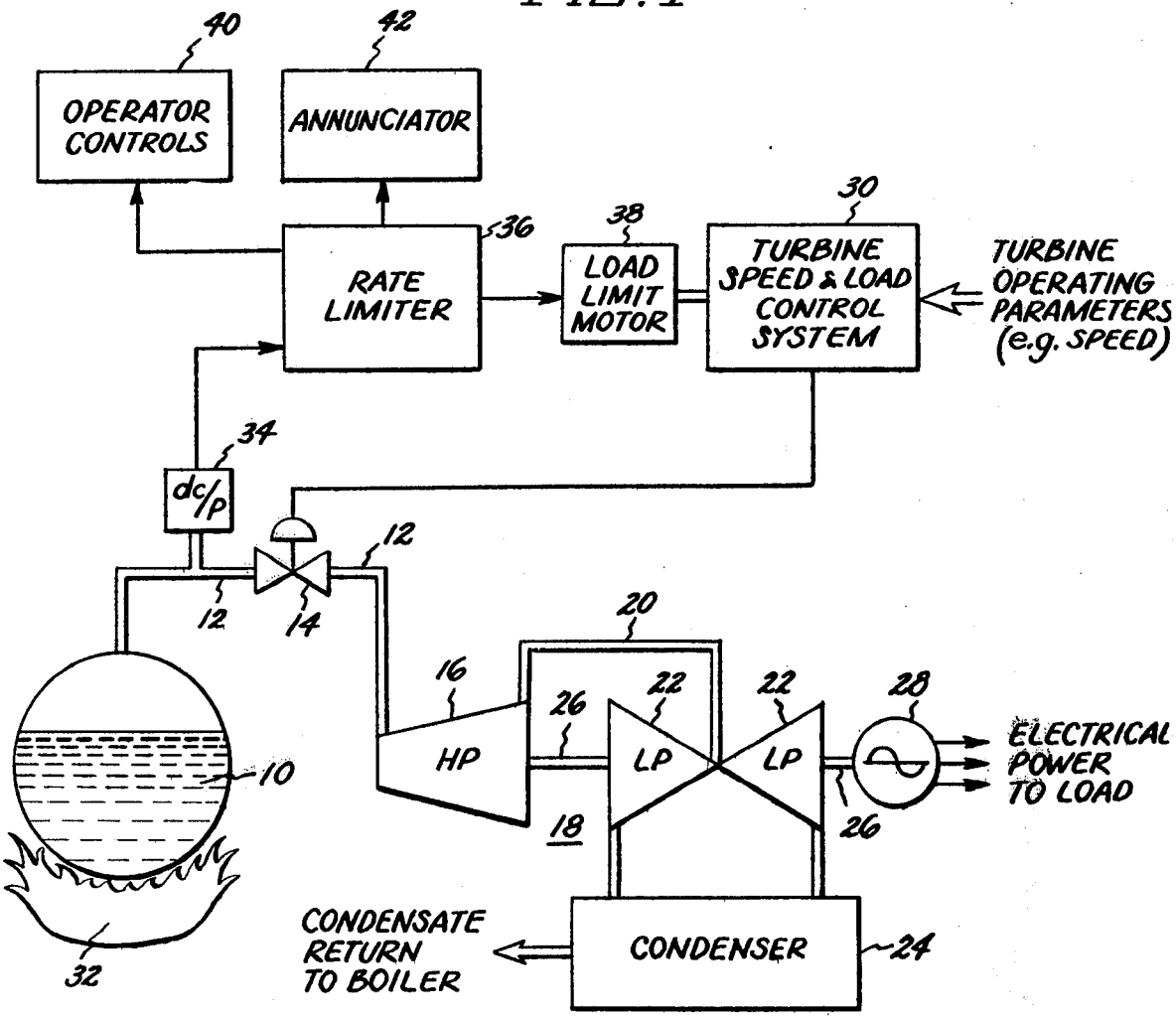
FIG. 1 is a greatly simplified schematic illustration of a power plant incorporating the present invention.

In the power plant of FIG. 1, steam generated in drum-type boiler 10 is passed by way of conduit 12 through admission control valve 14 to the high pressure section 16 of turbine 18. A cross-over conduit 20 conveys the steam exhausted from high pressure section 16 to a lower pressure section 22 and finally to condenser 24 from which the condensed steam is recycled to the boiler 10. Energy extracted from the steam by turbine sections 16 and 22 is utilized to impart rotary motion to shaft 26 and the units 16 and 22 are tandemly connected to drive electrical generator 28 which is connected to supply electrical power to a load (not shown). It will be recognized, of course, that FIG. 1 presents a power plant very much simplified for the purpose of illustrating and explaining the invention. For example, while control valve 14 is illustrated as a single valve, in an actual turbine installation a plurality of control valves are utilized for the admission of steam to the turbine 18 and are arranged upon nozzle arcs about the first high pressure stage of high pressure section 16. Other simplifications made in FIG. 1 will be readily apparent to those of ordinary skill in the art.

In the non-sliding pressure mode of operation (i.e., a somewhat more conventional mode), turbine speed and load are regulated by turbine control system 30 which receives information signals from various sensors (not specifically illustrated) reporting on operating parameters of the turbine 18, e.g., turbine speed. Accordingly, the control system 30 positions control valve 14 to admit more or less steam in satisfaction of the controller's demand to maintain speed and load at preselected values.

By contrast, in the sliding pressure mode of operation, to which the present invention is principally addressed, the control valve 14 is caused to be positioned fully open to minimize the steam pressure drop across the valve 14 and speed and load demands of the turbine 18 are met by causing the boiler pressure to increase or decrease (slide) as required. The amount of steam generated in boiler 10 is of course proportional to the heat input such as from flame 32 obtained by burning a fossil fuel. The advantage of the sliding pressure mode is realized principally when the turbine 18 is operated at reduced load.

As discussed above, the general object of the present invention is to protect the turbine 18 against the effects of a sudden drop in steam pressure as supplied by boiler 10. In broad outline, this is achieved in a rate initial pressure limiter system by providing a pressure transducer 34 to produce a signal which characterizes the steam pressure supplied by boiler 10; a rate limiter 36 which determines the rate of change of steam pressure, compares the rate with a preselected value, and actuates a load limit motor 38 for a time period proportional to the deviation of actual rate of change of steam pressure from the preselected value; a set of operator controls 40 by which operating personnel are able to test and maintain control of the system; and an annunciator 42 by which operating personnel are alerted to various system conditions. Functionally, actuation of load limit 38 causes a load limit value to be imposed on the control system 30 and thereby to position control valve 14 to counteract any sudden drop in steam pressure. It is conventional to include a motor driven load limit means in a turbine load and speed controller such as load limit motor 38 and controller 30 of FIG. 1. It will be apparent therefore to those of skill in the art that a rate initial pressure limiting system as herein described will be made operational through these means.

Figure 3:
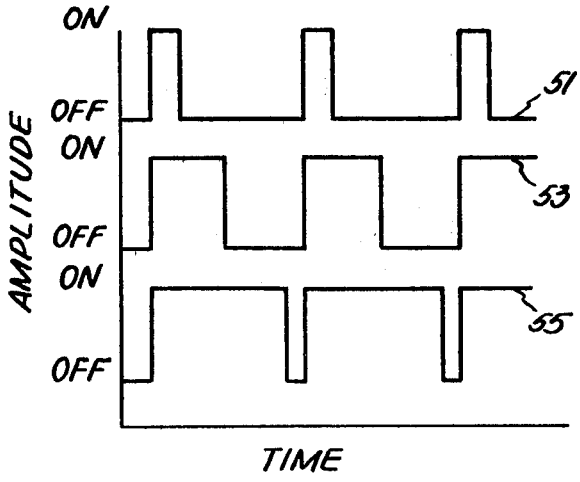
FIG. 3 illustrates wave forms obtained at one point in the block diagram circuitry of FIG. 2 and for three different rates of change of steam pressure.
Figure 2:
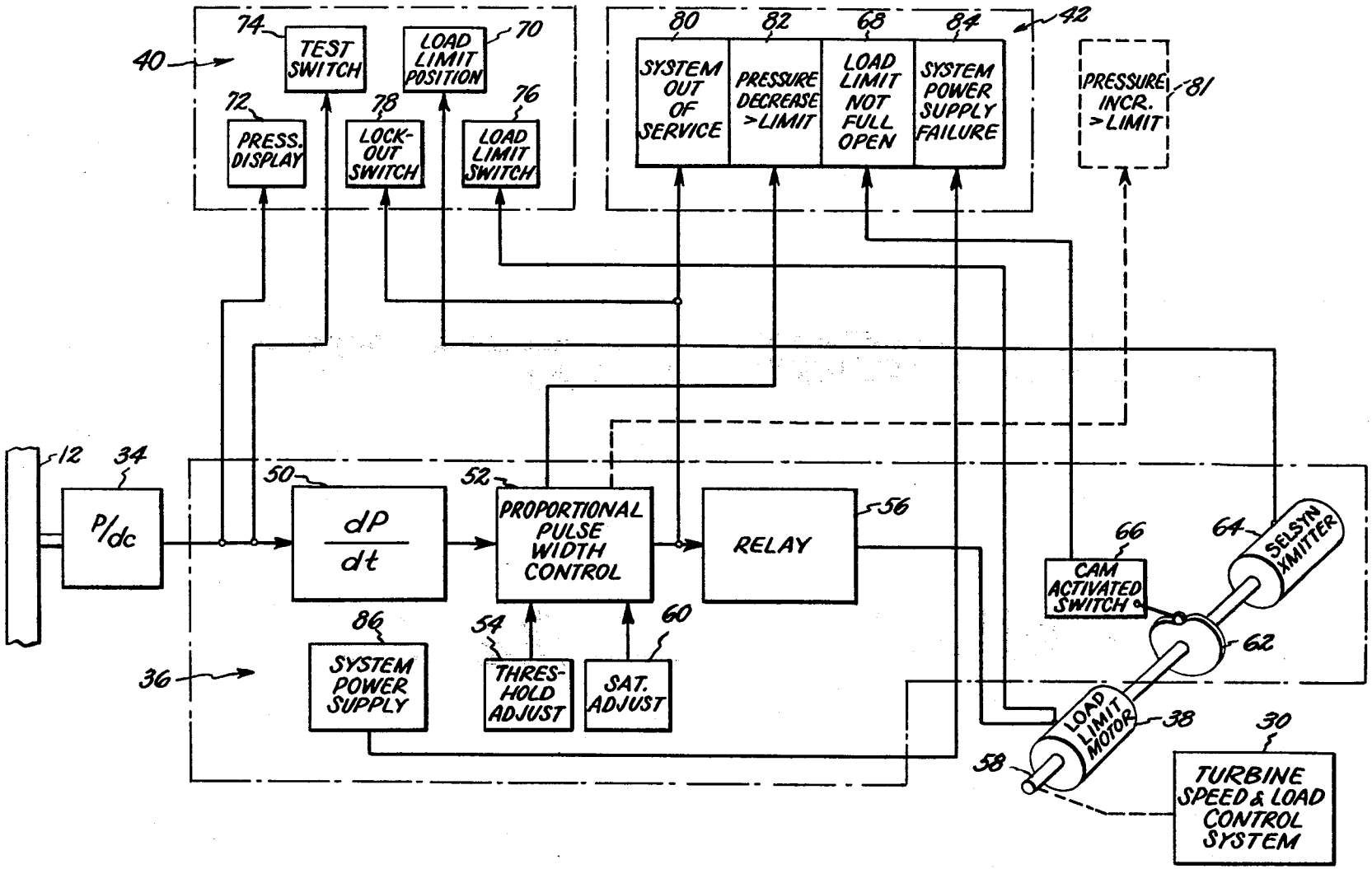
FIG. 2 is a detailed block diagram illustration of a rate initial pressure limiter according to the invention.

A detailed block diagram of portions of the system are presented in FIG. 2 wherein elements common to both FIGS. 1 and 2 are identically designated. With reference to FIG. 2, the output signal of pressure transducer 34 is supplied to a derivative circuit 50 which provides a signal output which is indicative of the time rate of change of the pressure signal. The output signal from derivative circuit 50 passes to a proportional pulse width circuit 52 which generates a pulse signal output whose pulse width is proportional to the amount by which the input rate signal exceeds a preselected threshold value. The threshold value is supplied to the proportional pulse width circuit 52 by threshold adjust 54. Threshold adjustment 54 provides for operator selection of the threshold value and allows changes to be made in the value for normal turbine and boiler operating conditions. FIG. 3 illustrates examples of the output pulse signal from proportional pulse width circuit 52 for three situations in which the threshold value is exceeded by different amounts. For example, pulse signal 51 is typical of the proportional pulse width signal in the situation wherein the threshold is only slightly exceeded; pulse signal 53 is for the situation wherein the value is exceeded to a greater extent; and pulse signal 55 results from a still greater excess and approaches 100% duty cycle or saturation of the output signal (at which time the higher level of the pulse signal is continuously present). The rate of change of steam pressure which will cause the pulse signal to become saturated is selectable by saturation adjustment 60. Generally, the pulse width is proportional to the rate at which the main steam pressure is decreasing. If there is no excessively fast decrease in pressure, there is no pulse output signal at all. It will be recognized that derivative circuit 50, proportional pulse width circuit 52 including threshold adjustment 54 and saturation adjustment 60 are circuits well-known to those of ordinary skill in the art.

The pulse signal from proportional pulse width circuit 52 actuates a relay 56 at such times as the pulse signal, as illustrated in FIG. 3, is at a high level. During the periods when relay 56 is actuated it applies power in a well-known manner to load limit motor 38 which has its output shaft 58 mechanically coupled to turbine speed and load control system 30 to cause a load limit internal to control system 30 to be reduced. With a reduced load limit in effect, control valve 14 will be caused to close down or throttle in the manner described in connection with FIG. 1. This has the effect of counteracting the sudden drop in steam pressure and, if necessary, closing valve 14 entirely to protect the turbine from water induction and other effects of the pressure drop.

Load limit motor 38 is also mechanically coupled to drive a cam 62 and a selsyn transmitter 64. Cam 62 activates a switch 66 whenever the load limit is less than fully maximum and makes such information known to operating personnel through indicator 68 of the annunciator 42. The selsyn transmitter 64, in a well-known manner, provides a continuous indication of the load limit position to the operator through position indicator 70 of the operator control panel 40. Additionally, operator control panel 40 includes a pressure indicator 72 by which the main steam pressure is read out, and a test switch 74 provides a simulation of a rapidly decreasing main steam pressure and therefore provides a test of the system's operability. Test switch 74 simulates a rapid pressure decrease, for example, by momentarily disconnecting pressure transducer 34 from derivative circuit 50 and then bringing the input line of derivative circuit 50 to a fixed value representing a lower pressure, e.g., this may be ground potential. If the system is functional, the test response will be to activate the load limit motor 38, switch 66, and indicator 68. Preferably, the test switch 74 is electrically interlocked with switch 66 so that once switch 66 is activated, and a positive indication is obtained indicating that the system is functional, the test will automatically be discontinued to prevent unnecessarily reducing the load.

Load limit switch 76 provides for manual positioning of load limit motor 38 and thus requires positive operator intervention to reset the load limit to its maximum position (full open) following its actuation due to a rapid drop in pressure or a test of the system. Additionally, a lockout switch 78 is provided to disengage the relay 56 and to temporarily remove the system from operation if desired. The lockout switch 78 also activates an indicator 80 to alert operating personnel that the system is out of service. Also provided as part of annunciator 42 are indicators 82 and 84, respectively, to show that the pressure is decreasing in excess of the threshold limit and to show a failure of the system power supply 86. Power supply 86 provides operating power to the various circuits of the system.

Summarizing briefly, operation of the system is as follows. Steam pressure in main steam line 12 is monitored by pressure transducer 34. Derivative circuit 50 provides a signal characterizing the rate of change of steam pressure which signal is in turn compared with a preselected threshold value in proportional pulse width circuit 52. If the threshold value is exceeded, a power relay 56 is actuated on a duty cycle proportional to the amount by which the threshold is exceeded. This causes a load limit motor 38 to operate at the same duty cycle and to reduce the turbine load limit in turbine speed load control system 30. The control system 30 causes the steam admission control valve 14 (FIG. 1) to close down and counteract the pressure drop and, indeed, to close entirely if the pressure drop continues unabated. Means are provided to inform the operator of the status of the system and to allow operator intervention as necessary.

Thus, while the invention has been described in detail with reference to a specific preferred embodiment, it is understood that various modifications will be apparent to those skilled in the art of control and monitoring systems for steam turbines. For example, although a preferred embodiment has been shown for protection of a steam turbine against sudden decreases in steam pressure, it will be readily apparent that the inventive concept is applicable for alerting operating personnel of excessively rapid increases in steam pressure, and, therefore, for protection against both rapid increases and decreases in pressure. FIG. 2, for example, by dashed lines illustrates an added indicator 81 to show that the pressure is increasing in excess of the threshold rate. It is intended to claim all such modifications which fall within the true spirit and scope of the present invention.

The invention claimed is:

1. In combination with a steam turbine and a turbine speed and load control system, said steam turbine supplying power to a load and operating in a sliding pressure mode of operation wherein a steam generator supplies pressurized steam to said turbine through steam control valves which are positioned fully open during the normal sliding mode of operation, and the turbine's speed and load demand is met by causing said steam generator to increase or decrease as required by said turbine's speed and load demand, a control system for protecting the turbine against the effects of sudden changes in the steam supply pressure, comprising:

pressure sensing means providing a signal indicative of the pressure of said pressurized steam while said turbine is operating in said sliding mode;

rate sensing means providing a rate signal indicative of the time rate of change of said pressure signal;

rate limit detection means providing a correction signal whenever said rate signal exceeds a preselected rate value corresponding to said sudden change in pressure; and means responsive to said correction signal to generate and impose a load limit value on a load limit motor connected to said turbine speed and load control system, and said speed and load control system responding to said motor by positioning said control valves in a direction to counteract said change in pressure in opposition to said valve's normal position during said sliding mode of operation while said speed and load control system substantially maintains the speed of the turbine at a preselected value.

2. The combination of claim 1 wherein:

said rate limit detection means provides said correction signal only when said rate signal is indicative of a sudden decrease in pressure; and said turbine speed and load control system includes means to position said control valves in a more closed direction when said load limit value effects said motor.

3. The combination of claim 2 wherein said rate limit detection means is a proportional pulse width circuit and said correction signal is a pulse signal whose duty cycle is proportional to the amount by which said rate signal exceeds said preselected rate value.

4. The combination of claim 1, 2, or 3 further including test means for simulating a decrease in pressure in excess of said preselected rate value so that operability of such protection control system is determined.

5. The combination of claim 4 further comprising an operator control panel, said panel including means for visually displaying the pressure of said pressurized steam and means for manually selecting such protection control system to be in or out of service.

6. The combination of claim 2 further including an indicator means for displaying relative load limit value, said indicator means being actuated by a selsyn transmitter mechanically coupled to said load limit motor.

7. The combination of claim 6 further including indicator means for displaying said relative load limit value.

8. The combination of claim 7 further including an annunciator, said annunciator including an indicator adapted to shown when such protection system is out of service; an indicator adapted to show when said pressurized steam is decreasing in pressure greater than said preselected rate; an indicator adapted to show when said relative load limit value is less than a maximum value; and an indicator adapted to show loss of power for such protection system.

9. The combination of claim 8 wherein said annunciator further includes an indicator adapted to show when said pressurized steam is increasing in pressure greater than said preselected rate.

10. In combination with a steam turbine and a turbine speed and load control system, said steam turbine supplying power to a load and operating in a sliding pressure mode of operation wherein a steam generator supplies pressurized steam to the turbine through steam control valves and said steam control valves are normally positioned fully open during said sliding mode of operation, and the turbine's speed and load demand is met by causing said steam generator to increase or decrease the supply of steam available to said turbine as required by said speed and load demand, a control system for protecting the turbine against the effects of sudden changes in the steam supply pressure, comprising:

pressure sensing means providing a signal indicative of the pressure of said pressurized steam while said turbine is operating in said sliding mode;

rate sensing means providing a rate signal indicative of the time rate of change of said pressure signal;

rate limit detection means providing a correction signal whenever said rate signal exceeds a preselected value indicative of a sudden decrease in pressure and water induction in the steam; and means responsive to said correction signal to generate and impose a load limit value on said turbine speed and load control system and said latter control system positioning said control values in a direction effective to counteract said sudden decrease in pressure, said positioning of said control valves being in opposition to the normal position of said valves during said sliding mode of operation, and said turbine speed and load control system substantially maintaining the speed of the turbine at a preselected value.

* * * * *